US006312311B1

(12) United States Patent
Wilhelm et al.

(10) Patent No.: US 6,312,311 B1
(45) Date of Patent: Nov. 6, 2001

(54) WATER TOWER ASSEMBLY WITH VARIABLE WATER LEVEL

(75) Inventors: Michael G. Wilhelm, Sycamore; Robert Cecchini, Chicago, both of IL (US)

(73) Assignee: Learning Curve International, Inc., Chicago, IL (US)

( * ) Notice: Subject to any disclaimer, the term of this patent is extended or adjusted under 35 U.S.C. 154(b) by 0 days.

(21) Appl. No.: 09/501,193

(22) Filed: Feb. 10, 2000

Related U.S. Application Data

(60) Provisional application No. 60/119,838, filed on Feb. 12, 1999.

(51) Int. Cl.[7] ..... A63H 17/44; A63H 19/36; A63H 33/42

(52) U.S. Cl. ..... 446/483; 40/406; 446/129; 446/267

(58) Field of Search ..... 40/406; 446/129, 446/267, 476, 483

(56) References Cited

U.S. PATENT DOCUMENTS 2,589,757 * 3/1952 Williams .
3,071,888 * 1/1963 Knott ..... 446/267
3,733,738 * 5/1973 Kramer ..... 446/267
5,236,384 * 8/1993 Frabricant et al. ..... 446/267

FOREIGN PATENT DOCUMENTS

444632 * 5/1927 (DE) ..... 446/483

OTHER PUBLICATIONS

"Esso Magic Gas Pump", from Amsco Toys 1966 catalog.*
1997 Wholesale Catalog by Learning Curve Toys p. 27.

* cited by examiner

*Primary Examiner*—John A. Ricci
(74) *Attorney, Agent, or Firm*—Wallenstein & Wagner, Ltd.

(57) ABSTRACT

The present invention provides a water tower generally having a base portion, a tower support attached to the base portion, and a fluid vessel attached to the tower support and containing a fluid. A buoyant vessel having a first magnet attached is contained within the fluid vessel. A first arm defining a cam slot and rotatably attached to the tower support by a first pivot pin guides a second arm, an end of which is disposed within the cam slot. The second arm is rotatably attached to the tower support by a second pivot pin. A second magnet is attached to a second end of the movable arm. In operation, the first arm is rotated to move a second arm, bringing the first and second magnets into alignment. The magnets create an attraction force which sinks the buoyant vessel within the fluid, giving the water tower the appearance of being full. When the first arm is rotated so magnets are taken out of axial alignment, the attraction force of the magnets is diminished, and the buoyant vessel floats. This causes the water tower to have the appearance of being nearly empty.

11 Claims, 4 Drawing Sheets

WATER TOWER ASSEMBLY WITH VARIABLE WATER LEVEL

RELATED APPLICATION

This application claims the benefit of Provisional Patent Application Ser. No. 60/119,838, filed Feb. 12, 1999.

TECHNICAL FIELD

The present invention relates to toy vehicle track. More specifically, it relates to a toy vehicle track with a water tower assembly, wherein the fluid level within the tower can be made to appear full or empty.

BACKGROUND OF THE INVENTION

In the toy vehicle industry, small toy trains are often run on plastic or wooden tracks. These railway systems are designed to grow with the child. In other words, railway configurations can range from very simple ovals to complex systems incorporating bridges, buildings, tunnels, and towns. Many other accessories are available as well, such as toy figurines, bushes, shrubs, and trees to lend the system a realistic effect; playmats, playboards, and play tables on which to build a railway system; carry bags and boxes in which to store the railway system when not in use; and, storybooks, iron-ons, decals, and coloring books to further stimulate the child's imagination.

The railway configurations are built from individual track sections. The track sections range in size and shape. There are countless possibilities for individual track sections: some are straight; some feature switching mechanisms; some are curved; and, some are ascending for connection to another track positioned at a higher level. One of the most important aspects of these railway systems is that the track sections be interchangeable. Accordingly, most track sections include male and/or female connectors at opposing ends. This allows the track sections to be connected end to end in a variety of configurations. Adding to the interchangeability of the track sections is the fact that these track sections are usually reversible having rails impregnated on both sides.

In addition, designers are constantly seeking to impart realism to the toy railway systems. In order to do this, designers have sought to introduce miniature accessories that resemble their real life counterparts. For example, locomotive turntables, highway crossings, lighthouses, tunnels, engine sheds, platform stations, draw bridges, windmills, and locomotive roundhouses are but a few of the many accessories available to add realism to the toy railway systems.

In particular, designers have discovered that children enjoy playing with accessories that have moving parts and/or produce sounds. Accordingly, many of the accessories currently available include movable parts such as levers, rotational handles, lifting mechanisms, and the like. Other accessories produce sounds. These include toy tracks that are designed to reproduce the sound an actual locomotive makes as it travels on actual train tracks, and locomotive whistles.

Thus, toy designers are always seeking to improve toy railway systems by introducing novel and interesting accessories which will capture a child's imagination.

SUMMARY OF THE INVENTION

The present invention relates to a fluid tower for incorporation into a toy vehicle set. The fluid tower comprises a fluid holding assembly, and a two-piece tower support. In use, the fluid tower simulates the transfer of a fluid, such as water or fuel, from the fluid holding assembly to a toy vehicle.

The fluid holding assembly includes a fluid vessel having an open end. The fluid vessel is attached to the two-piece tower support. The fluid vessel contains a piston or inner cylinder. The inner cylinder is dimensioned such that there is a gap for receiving a fluid level between the fluid vessel and the inner cylinder. A first magnet is attached to the inner cylinder.

The fluid holding assembly further includes a spigot or first arm which is rotatably attached to the fluid tower. The fluid holding assembly also includes a pivoting or second arm. The pivoting arm is joined to the two-piece tower support.

A second magnet is fixedly attached to the pivoting arm. The second magnet may be selectively, axially aligned with the first magnet which is fixedly attached to the inner cylinder. A force between the first and second magnets is used to selectively raise and lower the piston within the fluid vessel.

When the fluid tower is in a ready state such that the spigot is in a raised positioned, the fluid level in the fluid vessel substantially fills the gap between the fluid vessel and the inner cylinder. Thus, in the ready state, it appears as though the fluid vessel is completely filled with fluid.

When the fluid tower is in the activated state, the spigot is in a lowered position. The fluid level within the gap between the fluid vessel and the inner cylinder is at a lower level than the ready state. Thus, in the activated state, it appears as though the fluid vessel has experienced a decrease in the amount fluid.

Other features and advantages of the invention will be apparent from the following specification taken in conjunction with the following drawings.

DETAILED DESCRIPTION OF THE INVENTION

Figure 1:
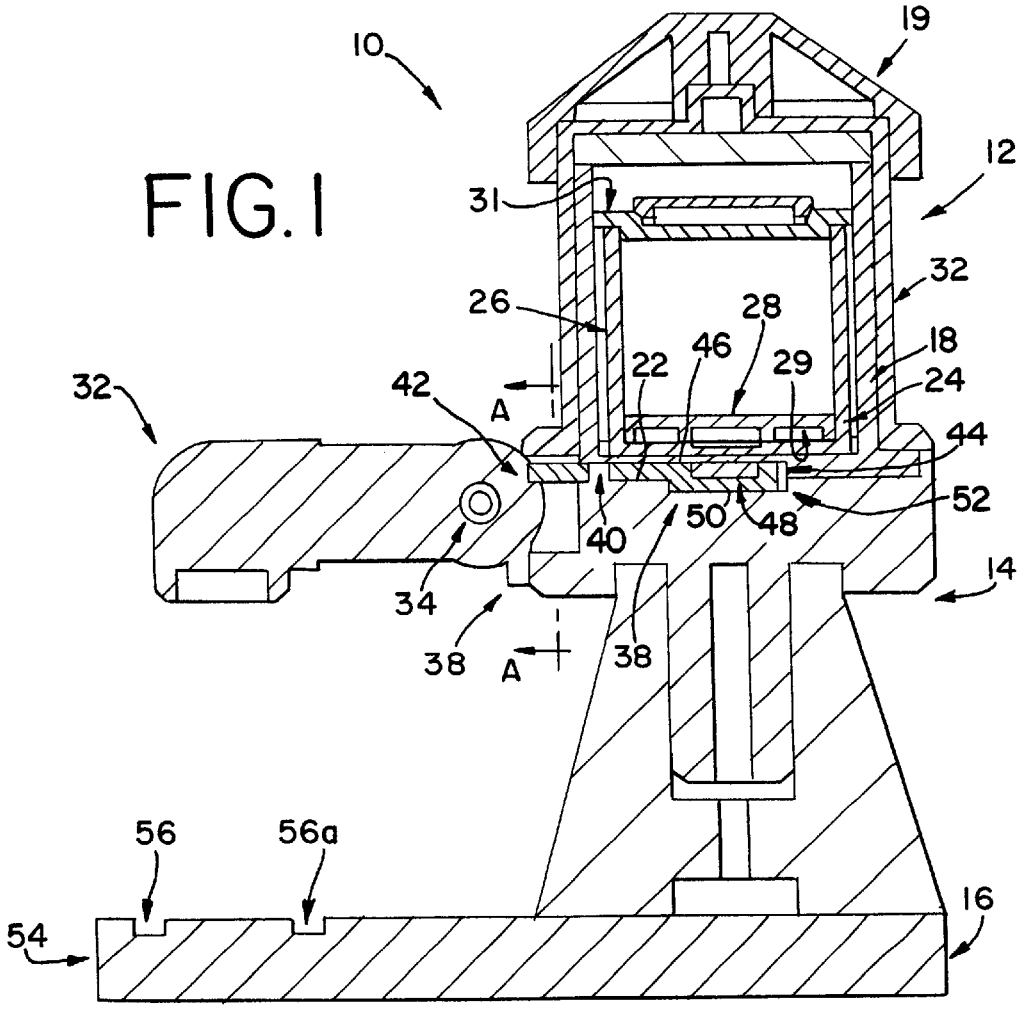
FIG. 1 is a sectional view of water tower assembly according to an embodiment of the present invention.

While the invention is susceptible of embodiment in many different forms, there is shown in the drawings and will herein be described in detail a preferred embodiment of the invention. It is to be understood that the present disclosure is to be considered only as an example of the principles of the invention. This disclosure is not intended to limit the broad aspect of the invention to the illustrated embodiment. The scope of protection should only be limited by the accompanying claim.

A fluid tower 10 for incorporation into a toy vehicle set is illustrated in FIG. 1. The fluid tower 10 comprises a fluid holding assembly 12, a two-piece tower support 14, and a base portion 16. In use, the fluid tower simulates the transfer of a fluid, such as water or fuel, from the fluid holding assembly 12 to a toy vehicle (not shown).

Figure 2:
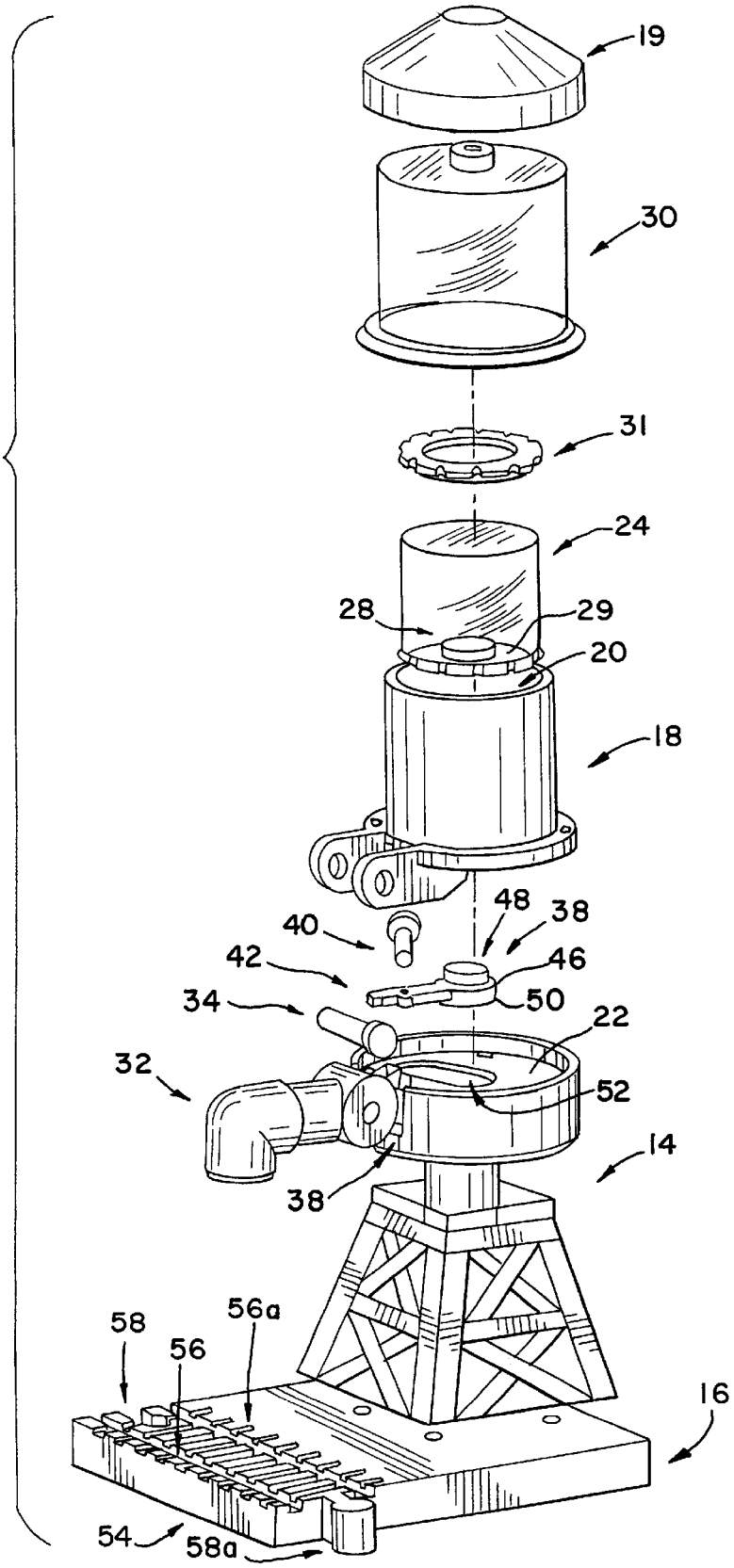
FIG. 2 is an exploded view of the assembly of FIG. 1.

Referring to FIGS. 1 and 2, the fluid holding assembly 12 includes a translucent fluid vessel 18 having an open end 20. The fluid vessel 18 is attached to an upper surface 22 of the two-piece tower support 14. The fluid vessel 18 contains a piston pump or inner cylinder 24. The inner cylinder 24 is dimensioned such that there is a gap 26 for receiving a fluid level 27 (shown in FIG. 3) between the fluid vessel 18 and the inner cylinder 24. A sealing member 31 forms a seal between the fluid vessel 18 and the inner cylinder 24. A first magnet 28 is attached to an underside 29 of the inner cylinder 24.

A clear protective cover 30 is disposed around the fluid vessel 18. The protective cover 30 is fixedly attached to the tower support 14. A decorative cap 19 is attached to the protective cover 30.

Figure 5:
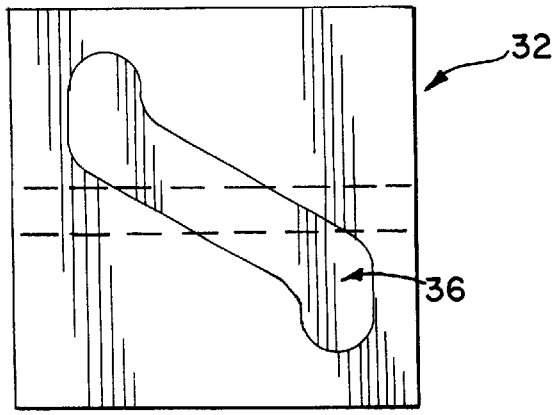
FIG. 5 is a front view of the cam slot of the first arm according to an embodiment of the present invention.

The fluid holding assembly 12 further includes a spigot or first arm 32 which is rotatably attached to the fluid tower 10 by a first pivot pin 34. The first pivot pin 34 joins the spigot 32 to the tower support 14 and the fluid vessel 18. The first pivot pin 34 also defines a horizontal axis about which the spigot 32 pivots. A stop 38 is attached to the spigot 32 to prevent the spigot from over rotating beyond a substantially horizontal position. The spigot also defines a cam slot 36 (shown in FIG. 5). The purpose of the cam slot 36 will become clear with further description.

The fluid holding assembly 12 also includes a pivoting or second arm 38. The pivoting arm 38 is joined to the upper surface 22 of the two-piece tower support 14 by a second pivot pin 40. The second pivot pin 40 defines a vertical axis about which the pivoting arm 38 pivots.

The pivoting arm 38 has a distal end 42 and a proximal end 44. The distal end 42 fits within the cam slot 36 defined by the spigot 32. The proximal end 44 includes a top side 46 to which a second magnet 48 is fixedly attached and a bottom side 50 which fits within a guide slot 52 located on the upper surface 22 of the two-piece tower support 14. The guide slot 52 maintains the proximal end 44 of the pivoting arm 38 in proper position along the upper surface 22 of the two-piece tower support 14.

The second magnet 48 may be selectively, axially aligned with the first magnet 26 which is fixedly attached to the underside 29 of the inner cylinder 24. The second magnet 48 oriented such that there is a repelling force between it and the first magnet 28 when they are axially aligned. The repelling force suspends the inner cylinder 24 in a raised position.

The fluid holding assembly 12 and the two-piece tower support are positioned above the base portion 16. The base portion 16 includes a length of toy vehicle track 54 over which a toy vehicle may traverse. Accordingly, the length of track 54 includes a pair of grooves 56, 56*a* which are designed to guide the toy vehicle. The length of track 54 further includes track connectors 58, 58*a* for joining the fluid tower 10 to other track segments and incorporation into to a toy vehicle track system.

Figure 3:
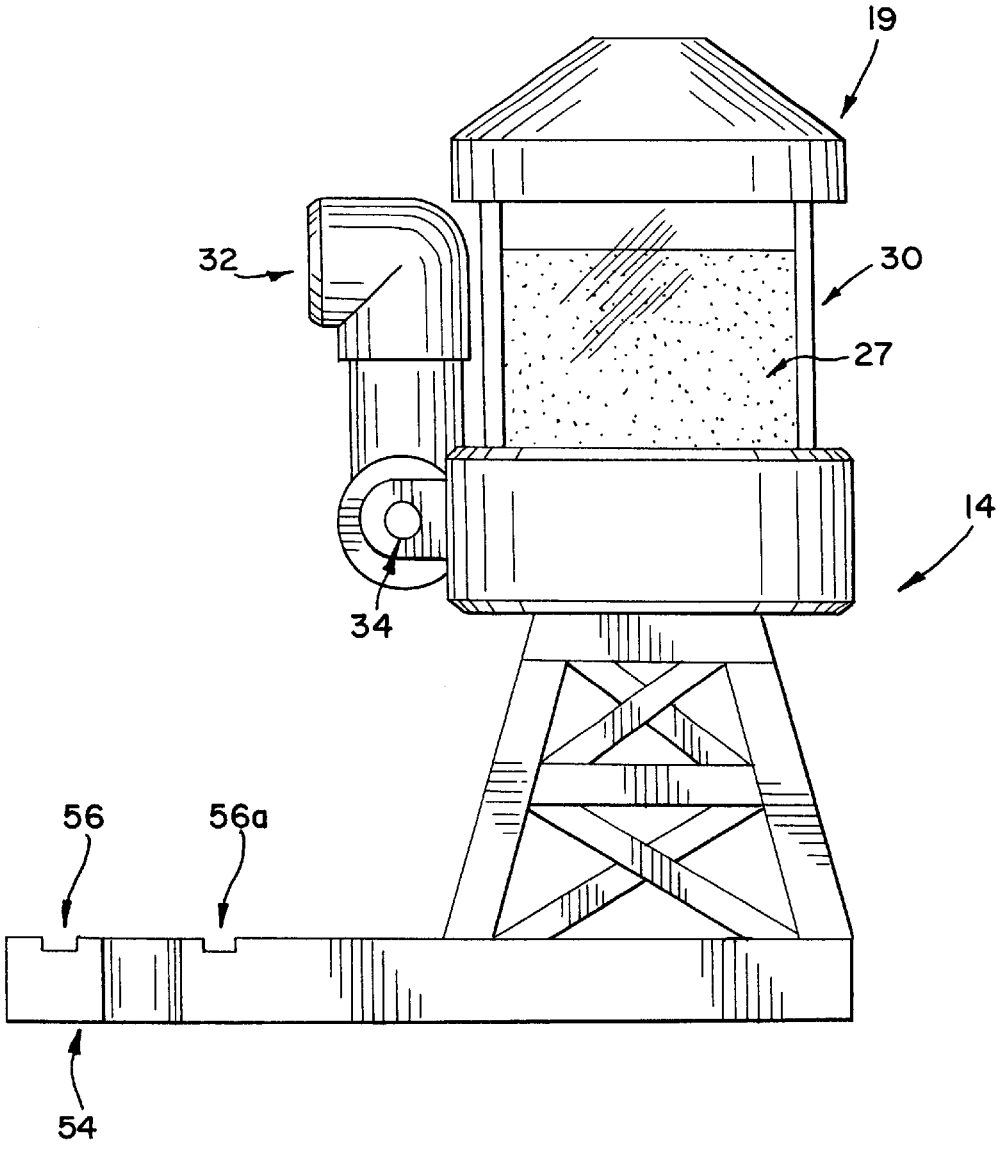
FIG. 3 is a side view of the water tower FIG. 1 with a first arm in a first position.

Now referring to FIG. 3, the fluid tower 10 is in a ready state such that the spigot 32 is in a raised positioned. In the ready state, the fluid level 27 in the fluid vessel 18 substantially fills the gap 26 between the fluid vessel 18 and the inner cylinder 24. Thus, in the ready state, it appears as though the fluid vessel 18 is completely filled with fluid.

Figure 4:
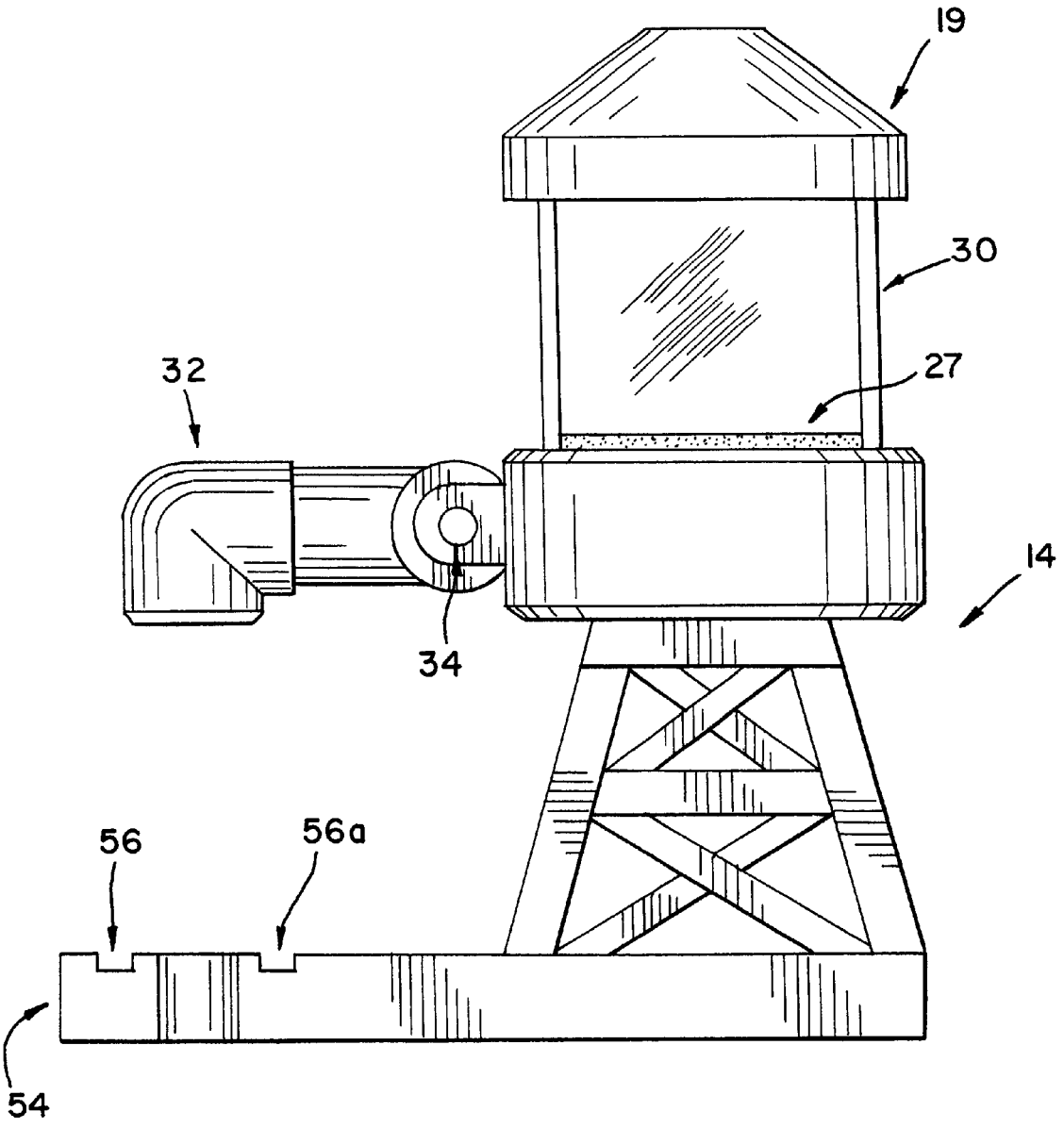
FIG. 4 is a side view of the water tower FIG. 1 with a first arm in a second position.

The activated state is illustrated in FIG. 4. In the activated state, the spigot 32 is in a lowered position. The fluid level 27 within the gap 26 between the fluid vessel 18 and the inner cylinder 24 is at a lower level than the ready state. Thus, in the activated state, it appears as though the fluid vessel 18 has experienced a decrease in the amount fluid.

In operation, the user rotates the spigot 32 downwardly about the horizontal axis defined by the first pivot pin 34 from the ready state to the activated state. As the spigot 32 is lowered, the distal arm 42 of the pivoting arm 38 follows the cam slot 36. This moves the pivoting arm 38 about the vertical axis defined by the second pivot pin 40. The proximal end 44 of the pivoting arm 38 moves within the guide slot 52 in the upper surface 22 of the two-piece tower support 14. This movement takes the second magnet 48 into axial alignment with the first magnet 26 which is attached to the underside 29 of the inner cylinder 24. Thus, the repelling force between the first and second magnets 26, 48 is applied, and the inner cylinder 24 rises from a lower position to a higher position.

As a result of the inner cylinder 24 rising, the fluid level 27 in the gap 26 between the fluid vessel 18 and the inner cylinder 24 lowers, giving the fluid water tower 10 a depleted appearance, as illustrated in FIG. 4.

By rotating the spigot 32 upwardly, back to the position of FIG. 3, the first magnet 28 and the second magnet 48 are taken out of axial alignment and the repelling force between the magnets 28, 48 is weakened or eliminated. The weakened repelling force allows the inner cylinder 24 to sink and the fluid level 27 rises within the gap 26 between the fluid vessel 18 and the inner cylinder 24, thereby giving the fluid vessel 18 the appearance of being nearly full, as shown in FIG. 3.

It should also be understood, that the first and second magnets 28, 42 may be oriented such that an attractive force exists between them. In this example, when the spigot 32 is lowered the first and second magnets would move from axial alignment to a non-aligned position. The inner cylinder 24 would rise and the fluid level 27 in the gap 26 would decrease.

While the specific embodiment has been illustrated and described, numerous modifications come to mind without significantly departing from the spirit of the invention, and the scope of protection is only limited by the scope of the accompanying claim.

What is claimed is:

1. A fluid tower accessory for use in a toy vehicle system comprising a plurality of vehicle track segments over which a toy vehicle travels, the fluid tower accessory comprising:

a tower support for supporting a sealed fluid vessel having an inner wall and an outer wall;

a fluid within the sealed fluid vessel; and a pump for selectively raising and lowering the fluid within the sealed fluid vessel.

2. The fluid tower of claim 1 wherein the sealed fluid vessel has an inner wall and an outer wall, and the pump comprises a piston located within the sealed fluid vessel, the piston having a side wall which in combination with inner wall of the sealed vessel, forms a gap for receiving a portion of the fluid between the side wall of the piston and the inner wall of the sealed fluid vessel.

3. The fluid tower of claim 2 further comprising a rotatable first arm for selectively raising and lowering the piston within the fluid vessel wherein raising and lowering the piston selectively increases or decreases an amount of fluid within the gap giving the fluid tower an appearance that it is substantially empty or an appearance that it is substantially full.

4. A fluid tower accessory for use in a toy vehicle system comprising a plurality of vehicle track segments over which a toy vehicle travels, the fluid tower accessory comprising:

a tower support having an upper surface for supporting a sealed fluid vessel having an inner wall and an outer wall;

a piston having a side wall and located within the fluid vessel so that a gap is formed between the side wall of the piston and the inner wall of the fluid vessel;

a fluid within the gap between the inner wall of the fluid vessel and side wall of the piston; and a rotatable first arm for selectively raising and lowering the piston within the fluid vessel wherein raising and lowering the piston selectively increases or decreases an amount of fluid within the gap giving the fluid tower an appearance that it is substantially empty or an appearance that it is substantially full.

5. The fluid tower accessory of claim 4 further comprising a first magnet fixedly attached to the piston and selectively axially alignable with a second magnet interconnected to the rotatable first arm wherein rotating the rotatable first arm aligns the first and second magnets producing a force between the first and second magnets for selectively raising or lowering the piston.

6. The fluid tower of claim 5 further comprising a pivotable second arm having a distal end in communication with a cam slot defined by the rotatable first arm and a proximal end to which the second magnet is fixedly attached wherein rotating the rotatable first arm transfers movement to the pivotable second arm for selectively axially aligning the first and second magnets.

7. The fluid tower of claims 6 wherein the first magnet is fixedly attached to an underside of the piston.

8. The fluid tower of claim 7 wherein the upper surface of the tower support includes a guide slot for maintaining proper alignment of the proximal end of the pivotable second arm.

9. The fluid tower of claim 7 wherein the force produced upon axially aligning the first and second magnets is a repelling force so that selectively axially aligning the first magnet and the second magnet raises the piston.

10. The fluid tower accessory of claim 7 wherein the force between the first and second magnets is a repelling force wherein axially aligning the first and second magnets causes the piston to rise within the fluid vessel and the amount of fluid within the gap to decrease.

11. A fluid tower accessory for use in a toy vehicle system comprising a plurality of vehicle track segments over which a toy vehicle travels, the fluid tower accessory comprising:

a tower support having an upper supporting surface for supporting a sealed fluid vessel having an inner wall and an outer wall, the upper supporting surface having a guide slot;

a piston having a side wall and located within the fluid vessel so that a gap is formed between the side wall of the piston and the inner wall of the fluid vessel;

a fluid within the gap between the inner wall of the fluid vessel and side wall of the piston;

a first magnet fixedly attached an underside of the piston;

a rotatable first arm for selectively raising and lowering the piston within the fluid vessel and movable about a substantially horizontal axis defined by a first pin, the rotatable first arm defining a cam slot;

a pivotable second arm movable about a substantially vertical axis defined by a second pin and having a distal end in communication with the cam slot and a proximal end in communication with the guide slot wherein movement provided to the rotatable first arm transfers movement to the pivotable second arm; and a second magnet fixedly attached to the proximal end of the pivotable second arm and selectively axially alignable with the first magnet upon rotating the rotatable first arm wherein a force between the first magnet and the second magnet may be used to selectively raise or lower the piston within the fluid vessel wherein raising the piston decreases an amount of fluid within the gap giving the fluid tower an appearance that it is substantially empty and lowering the piston increases the amount of fluid within the gap giving the fluid tower an appearance that it is substantially full.

* * * * *

UNITED STATES PATENT AND TRADEMARK OFFICE

CERTIFICATE OF CORRECTION

PATENT NO. : 6,312,311 B1
DATED : November 6, 2001
INVENTOR(S) : Wilhelm et al.

It is certified that error appears in the above-identified patent and that said Letters Patent is hereby corrected as shown below:

Column 1,
Line 9, insert -- a -- after "to"

Column 2,
Line 61, delete "claim" and insert -- claims --

Column 3,
Line 41, delete "26" and insert -- 28 --
Line 57, delete "positioned" and insert -- postion --
Line 67, insert -- of -- after "amount"

Column 4,
Lines 10 and 12, delete "26" and insert -- 28 --
Line 28, delete "42" and insert -- 48 --

Column 5,
Line 27, delete "claims" and insert -- claim --

Column 6,
Line 15, insert -- to -- after "attached"

Signed and Sealed this

Second Day of July, 2002

*Attest:*

*Attesting Officer*

JAMES E. ROGAN
*Director of the United States Patent and Trademark Office*